US007371185B1

(12) United States Patent
Rohrer

(10) Patent No.: US 7,371,185 B1
(45) Date of Patent: May 13, 2008

(54) PUTTERHEAD WITH CENTER LINE FORWARD OFFSET HOSEL

(75) Inventor: John W. Rohrer, York, ME (US)

(73) Assignee: Rohrer Technologies, Inc., York, ME (US)

( * ) Notice: Subject to any disclaimer, the term of this patent is extended or adjusted under 35 U.S.C. 154(b) by 0 days.

(21) Appl. No.: 10/812,252

(22) Filed: Mar. 29, 2004

Related U.S. Application Data

(60) Provisional application No. 60/468,882, filed on May 8, 2003.

(51) Int. Cl.
*A63B 53/02* (2006.01)

(52) U.S. Cl. ..... 473/255; 473/313; 473/314; 473/340

(58) Field of Classification Search ..... 473/251–255, 473/313–314, 340–341
See application file for complete search history.

(56) References Cited

U.S. PATENT DOCUMENTS

| | | | | | |
|---|---|---|---|---|---|
| D182,485 | S | * | 4/1958 | Sprinkel | D21/745 |
| D259,732 | S | | 6/1981 | Vella | D21/221 |
| D271,604 | S | * | 11/1983 | Stone et al. | D21/741 |
| D272,257 | S | | 1/1984 | Perkins | D21/221 |
| 4,629,193 | A | * | 12/1986 | Pierman | 473/254 |
| 4,809,981 | A | * | 3/1989 | Doran et al. | 473/249 |
| D308,995 | S | * | 7/1990 | Colucci | D21/743 |
| 4,966,369 | A | | 10/1990 | Griffin | 273/80 A |
| D313,057 | S | * | 12/1990 | Gebhardt | D21/741 |
| 4,988,107 | A | * | 1/1991 | Sasse | 473/254 |
| 5,014,992 | A | | 5/1991 | McCallister | 273/164 |
| 5,072,941 | A | * | 12/1991 | Klein | 473/255 |
| 5,152,533 | A | * | 10/1992 | Radakovich | 473/206 |
| 5,267,733 | A | * | 12/1993 | Szokola | 473/313 |
| 5,292,128 | A | * | 3/1994 | Solheim | 473/313 |
| 5,340,106 | A | | 8/1994 | Ravaris | 273/164.1 |
| 5,382,019 | A | * | 1/1995 | Sneed | 473/304 |
| 5,489,097 | A | * | 2/1996 | Simmons | 473/326 |
| 5,544,883 | A | * | 8/1996 | Meyer | 473/313 |
| 5,569,098 | A | | 10/1996 | Klein | 473/300 |
| 5,630,766 | A | | 5/1997 | Granelli | 473/313 |
| D387,829 | S | * | 12/1997 | Blaine | D21/741 |
| 5,772,525 | A | | 6/1998 | Klein | 473/300 |
| D420,410 | S | * | 2/2000 | Pegg | D21/743 |
| 6,200,227 | B1 | | 3/2001 | Sery | 473/251 |
| 6,238,302 | B1 | * | 5/2001 | Helmstetter et al. | 473/340 |
| 6,422,949 | B1 | * | 7/2002 | Byrne et al. | 473/200 |
| 2004/0173964 | A1 | * | 9/2004 | Pollman | 273/252 |

* cited by examiner

*Primary Examiner*—Stephen Blau

(57) ABSTRACT

A golf putterhead having a neck or hosel connecting said putterhead to a shaft. The hosel protrudes above and forward of the strike face on the vertical centerline plane of the putterhead and above the intended strikepoint also in said plane. Said hosel section in front of the strikeface being high enough so as not to interfere with a golf ball. Said hosel in one preferred embodiment extends forward of the strikeface approximately one half a golf ball diameter and has a user visible target oriented sight line on its' upper surface. Said sight line also extends substantially rearward of the strikeface, for most or all of said putterheads fore to aft depth on said vertical centerline plane, thereby creating an extended sight line for aiming said putter at a target. This forward hosel to shaft connection point concurrently increases putterhead static balance moment about said shaft and achieves face static balance thus improving dynamic stability during putterhead acceleration.

11 Claims, 3 Drawing Sheets

PUTTERHEAD WITH CENTER LINE FORWARD OFFSET HOSEL

CROSS REFERENCE TO RELATED APPLICATIONS

Applicant claims benefit of the filling date of Provisional Application No. 60/468,882, filed on May 8, 2003, and priority of that date.

BACKGROUND OF THE INVENTION

Many putters have some top marking or upper putterhead geometry indicating the intended strikepoint of the putterhead and/or the sighting aiming line (perpendicular to the strikeface). Golfers using putters without a highly visible aim line must draw an imaginary line perpendicular to the strikeface and through the golf ball to the intended target. For most golfers, a putterhead aim line provides more accurate aim than an imaginary perpendicular line from the putterhead strikeface. Generally, the longer (front to rear) and more visible the aim line is, the more accurately one can aim the putter at the target.

The Rules of Golf, as promulgated by the United States Golf Association (USGA) and the Royal and Ancient Golf Club of Scotland (the "Rules"), limit putterhead length to putterhead width. The Rules also prohibit putterhead protrusions, including those in front of the putterface and rearward from the putter face or putterhead solely for purposes of aim or alignment. Hosels or necks for connecting shafts to putterheads and bent shafts protruding forward of the strikeface are allowed. They have always been popular because it is advantageous to have the shaft axis in front of the clubhead center of gravity. This produces a static balance moment about the shaft axis which increases dynamic stability when a golfer accelerates the putterhead by applying a forward force to the shaft. This dynamic stability is most effective, by resisting putterhead rotation, when the putterhead center of gravity is directly behind the shaft axis (rather than towards the toe or heal side of it).

Since under the Rules, putterhead length (fore to aft) can not exceed putterhead width, and because the Rules do not allow appendages solely for sighting or alignment, the length of most putterhead aim lines have historically been limited to putterhead length.

DISCUSSION OF THE PRIOR ART

Many, perhaps most, golf putters employ forward offset hosels or bent shafts (lower section) to place the shaft axis at or in front of the faceplate plane thus improving putter dynamic stability during both acceleration and ball impact by increasing the distance between the shaft axis and the putterhead center of gravity or mass (the static balance moment). Most modern putters achieve additional stability by being "face balanced", meaning the shaft axis intersects, forward of the center of mass, a horizontal line going through the center of mass perpendicular to the putterface (assuming 0° face loft). Solheim (U.S. Pat. No. 5,292,128), Meyer (U.S. Pat. No. 5,544,883) and Klein (U.S. Pat. Nos. 5,569,098 and 5,772,525) are examples of "face balanced" putters with forward offset hosels. None of these hosels, however, go through the center plane of the putterhead like the present invention and thus are without the sight line benefits of the present invention. One can quickly determine if a putter is "face balanced" by laying the putter's shaft horizontally across two horizontal bars (or fingers) and observing whether the putterface remains horizontal (face up).

One disadvantage of using forward offset hosels or forward bent shafts to increase the static balance moment while maintaining face balancing is that the hosel or shaft creates an asymmetrical sighting picture when viewed by a golfer from above. The offset hosel or bent shaft often obscures part of the golf ball when the ball is properly centered in front of the intended strikepoint on the putterface.

Only a forward offset hosel on the centerline vertical plane of the clubhead extending directly over the ball, like the present invention, can provide a symmetrical sighting picture when viewed from above. Several forward center line hosels are found in the prior art. None, however, provide an unobstructed and elongated sight line for improved putter aiming nor do they have the ability to be "face balanced" for improved dynamic stability.

Griffin (U.S. Pat. No. 4,966,369) describes a putterhead with a forward extending centerline plane hosel. The hosel does not form an unobstructed sight line like the present invention because the shaft connection (and shaft location) block any potential sight line. The hosel forward extension is not horizontal providing a poor and inaccurate sight line to the target if the golfer's eyes are not directly above the hosel and ball. Griffin can not be "face balanced" for dynamic stability because of the centerline plane hosel connection. No rearward sight line extension is possible. The primary purpose for Griffin's design is to get the center of mass in front of the strikeface unlike the present invention.

Szokola (U.S. Pat. No. 5,267,733) describes a tubular arculate (curved) hosel extension. Unlike the present invention, it protrudes from the rear wall of the putterhead vs. the top of the strikeface before curving forward. The curved length of the hosel therefor exceeds the 5 inch USGA Rules requirement, unlike the present invention. The shaft and curved hosel extension lie in a common plane which can be adjusted. When this plane is vertical, the hosel to shaft connection and shaft blocks any potential sight line and violates the Rules of Golf which require the shaft of a putter to be at least 10° from vertical. If the shaft hosel plane is tilted 10° or more toward the player to conform to the Rules, the forward hosel extension is no longer directly over the ball and putterhead centerline like the present invention. Like Griffin, and unlike the present invention, Szokola can not be "face balanced" for improved dynamic stability. Szokola does not describe or claim an extended, unobstructed sight line. Ravaris (U.S. Pat. No. 5,340,106) and Perkins (D 272,257) describe a putterhead similar to Szokola differing from the present invention for the same reasons.

Granelli (U.S. Pat. No. 5,630,766) and Gunderson (U.S. Pat. No. 6,497,628 B1) describes a centerline vertical plane hosel extension starting at the rear of the putterhead, but it does not extend past the strikeface like the present invention. Like Griffin, Szokola and Ravaris previously cited, the shaft and shaft connection prevent an unobstructed sight line and any opportunity for face balancing.

Byrne (U.S. Pat. No. 6,422,949 B1) describes a putterhead with sight line combined with a golf ball with matching sight lines. The putterhead sight line is not provided by a vertical centerline plane forward extending hosel like the present invention.

SUMMARY OF THE INVENTION

The present invention utilizes a novel forward offset hosel design to produce a sight line or aim line which can be longer than a putterhead's length, or width. The hosel proceeds forward from a position above the intended strike point on the strikeface in a vertical plane generally perpendicular to the strikeface. The sight or aim line also extends rearward along this same plane on a rearward extension of the putterhead body extending from the strikeface at the same or different elevation in such a manner that it is optically and/or physically connected or consistent with the forward hosel extension and hosel sight line on top of it along this plane. The rearward sight line extension of the hosel sight line goes the entire putterhead length (fore to aft) or a significant portion thereof. The forward extension of the hosel can go part way or all the way to a position slightly in front of a golf ball proximate to or in contact with the strikeface. The Rules limit overall hosel length (from the sole of the putterhead to the straight portion of the golf shaft) to 5 inches. In a preferred embodiment of the present invention, it is desirable for putter dynamic stability to have the shaft axis penetrate a vertical plane through the putterhead center of gravity and intended strikepoint, such plane being perpendicular to the strikeface, at the elevation of the center of gravity. This requirement, plus the maximum 5 inch hosel length of the Rules, limits the hosel forward extension length to about one half to one golf ball diameter in front of the strike face.

One object of the present invention is to provide a long unobstructed sight line by using the top of a putterhead center line located forward hosel extension, the hosel sight line, as part of said sight line which sight line also extends rearward, the "rearward sight line" at least twice the length of said hosel sight line.

A second object of the present invention is to provide a sight line portion forward of and above the strikeface, extending over all or part of a golf ball centered in front of and proximate to the intended strikepoint.

Still another object of the present invention is to provide an increased static balance moment by moving the hosel to shaft connection point and shaft axis well forward of the strikeface and putterhead center of gravity.

BRIEF DESCRIPTION OF THE DRAWINGS

The various features, advantages and operating principles of the present invention will become more apparent by reference to the following descriptions and drawings in which.

DESCRIPTION OF THE PREFERRED EMBODIMENTS

Figure 1:
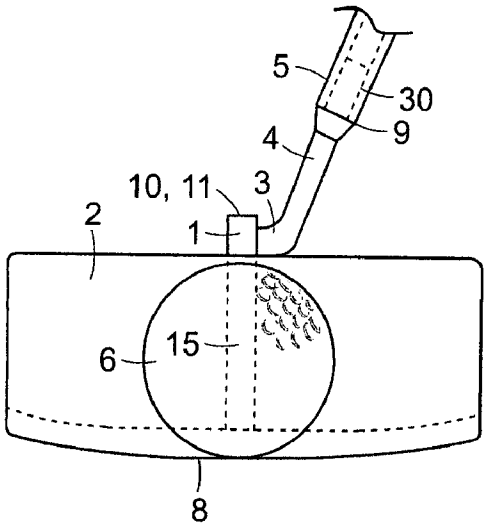
FIG. 1 is a frontal or face view of a putterhead of one embodiment of the present invention with a golf ball centered in front of said putterhead face.
Figure 2:
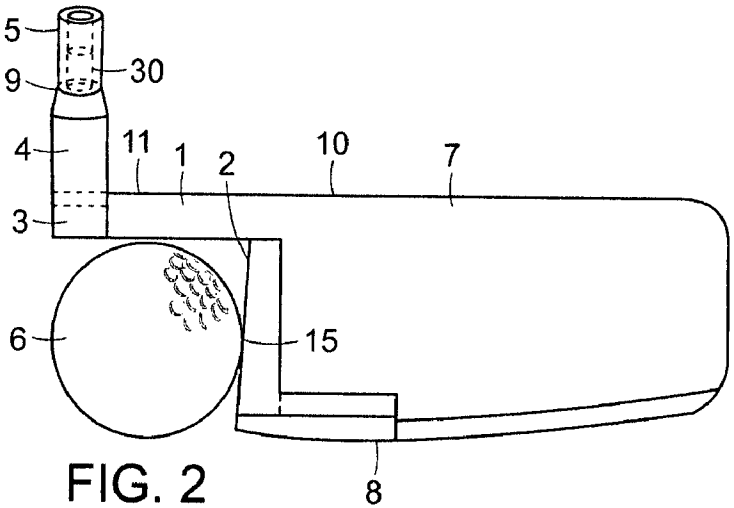
FIG. 2 is an elevational view of the embodiment of FIG. 1 with said golf ball proximate to said putterhead strikeface.
Figure 3:
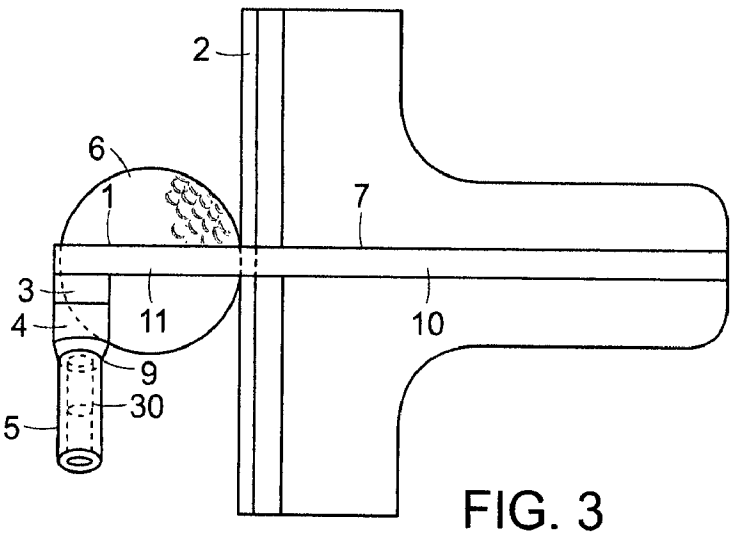
FIG. 3 is a plan view of the embodiment of FIGS. 1 and 2 with a golf ball in front of said face and under the extended hosel of the present invention.

Referring to the Drawings, FIGS. 1, 2 and 3 describe frontal or putterface elevational, side elevational and plan views, respectively, of one embodiment of the present invention in which the forward extending section 1 protrudes forward, generally horizontally, from the putterface 2 above the intended strikepoint 15 at an elevation above the putter soleplane equal to or greater than the diameter of a golf ball (1.68 inches or 4.27 mm) thus avoiding interference or contact with said hosel when a ball is being struck by said putter. In this embodiment said forward extending section 1, protrudes forward from the face a distance approximately equal to a golf ball. The lateral 3 and upward 4 shaft connecting hosel sections are so arranged that the putter shaft 5 does not obscure any portion of a golf ball 6 when viewed from above (FIG. 3). Alternatively, said shaft connecting hosel sections 3 and 4 may be replaced by a bent lower shaft section (not shown). The sight line on the top surface of the forward extending section 1, the "forward extending sight line" 11, and the "rearward extending sight line" 10 on the top surface of the rearward extension 7, together provide a longer sight line than would otherwise be possible without addition of said forward extending section 1 with said forward extending sight line 11. Said rearward extension 7 does not function as a hosel (shaft to clubhead connection), but provides or supports said rearward extending sight line 10, and may help support the faceplate 2 and said forward extending section 1 through (not shown) or above it (shown), or the sole 8. In this embodiment, the distance between the sole plane of the putterhead 8 and the straight shaft connection point 9 is equal to or slightly less than 5 inches or 12.7 mm as currently required under The USGA Rules of Golf. The end of said upward hosel section 4 is fitted with a stop surface 9 and a slip over protrusion or rod 30 (shown) or socket (not shown) for receiving and attaching via adhesive or other means, a puttershaft 5. That portion of the putterhead with said rearward extension 7 with rearward sight line 10 on top, protruding rearward from the putterface 2 has a length equal to or slightly less than the horizontal width of said putterhead 2. Said forward extending sight line 11 and rearward extending sight line 10 above said forward extending section 1 and rearward extension 7, respectively, are preferably of one color or finish (shown), contrasting with any adjacent putterhead portions visible to a golfer from above, or have a black or dark line (not shown) centered on said surface 10.

Figure 5:
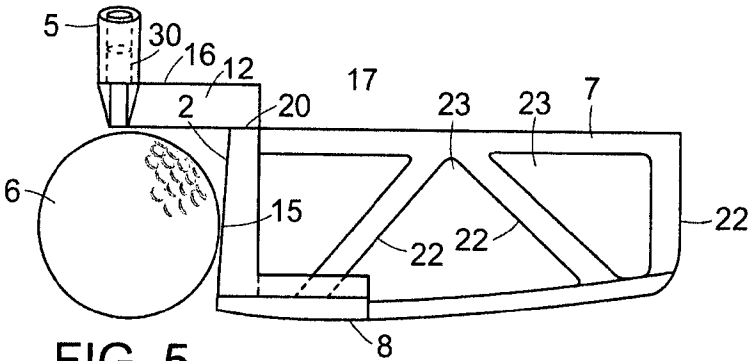
FIG. 5 is an elevational view of the embodiment of FIG. 4 also showing triangular shaped openings through the vertical member below the sight or aim line which member was solid in FIG. 2 with half of a golf ball below the forward extended hosel.
Figure 6:
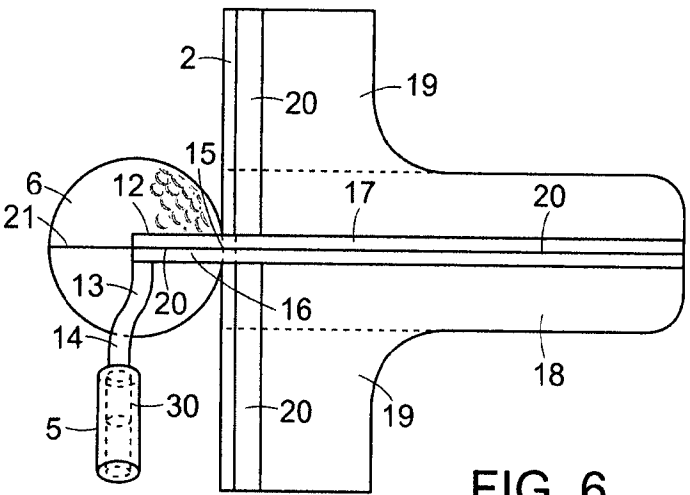
FIG. 6 is a plan view of the embodiment of FIG. 4 with half of a golf ball below the forward extended hosel.
Figure 4:
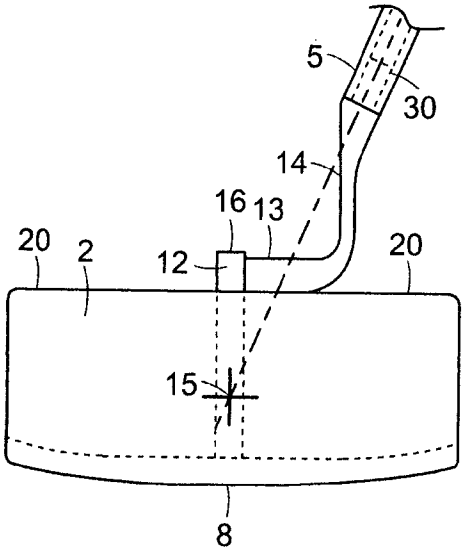
FIG. 4 is a frontal or face view of a putterhead of a second embodiment of the present invention in which the shaft axis intersects both the horizontal and vertical planes through the putterhead center of gravity.

FIGS. 4, 5, and 6 show a preferred embodiment of the present invention where the forward extending section 12 extends approximately ½ golf ball diameter forward of the putterface 2. The lateral hosel section 13 is longer and may be of thinner section than in the prior embodiment (3 in FIGS. 1, 2 and 3). This makes this section 13 and the lower shaft 5 over hosel protrusion 30 less visible when viewed by a golfer from above (FIGS. 3 and 6). To further reduce the shaft connecting hosel section visibility and any related sighting distraction, that portion of the lateral hosel section 3 or 13 or bent lower shaft lying over a golf ball (which ball 6 is touching or near the putterface 2 at or near the intended strikepoint 15) can be painted or finished white or light in color to take such hosel section 3 or 13 out of optical view and blend with the ball below it. To further enhance the sight picture when viewed by a golfer from above, the first several inches of the golf shaft 5 near the hosel and now directly over the ball can be painted or finished dull green or other dark non-glossy color.

Said rearward extending sight line 10 and forward extending sight line 11 may be on one level, per FIGS. 1, 2, and 3 or of differing levels, per the forward extending sight line 16 and rearward extending sight line 17 in FIGS. 4, 5, and 6. These sight lines, 16 and 17, may be preferably of white or light finish with a contrasting black or dark sight or aim line 20 (as shown in FIG. 6) or of a single color. The top surface of the putter sole 18 and any other putter surfaces visible to a golfer from above can be of a color contrasting with the color of 10, 16 or 17. In the preferred embodiment of FIG. 6, that portion of the sole plate 18 and other putterhead surfaces visible to a golfer from above which are within ½ golf ball diameter of the centerline are of light or white finish, while more remote surfaces, 19 and 20, are of a contrasting dull dark or green finish to take them out of optical view. In this manner, the light or white surfaces, being centered and of approximately one ball diameter in width, establish a sighting field which includes, and is extended by, the golf ball 6 near or contacting the strikepoint 15 of the putterface 2 when viewed by a golfer from above at address. An aim line 20, preferably dark or black, centered on the top surface of the forward extending sight line 16 and rearward extending sight line 17 or the entire top surfaces of 16 and 17, of dark or black finish, can be further extended by placing a dark or black partial or full circumferenced line 21 of similar width on an equator of the golf ball and orientating such line toward the target prior to addressing the ball with a putterhead of the present invention.

FIG. 5 shows that the rearward extension 7 need not be of solid construction to reduce or redistribute putterhead weight. This rearward extension 7 may contain holes or apertures 23, or be made of lighter weight materials (not shown), or supported by structural members 22.

Figure 7:
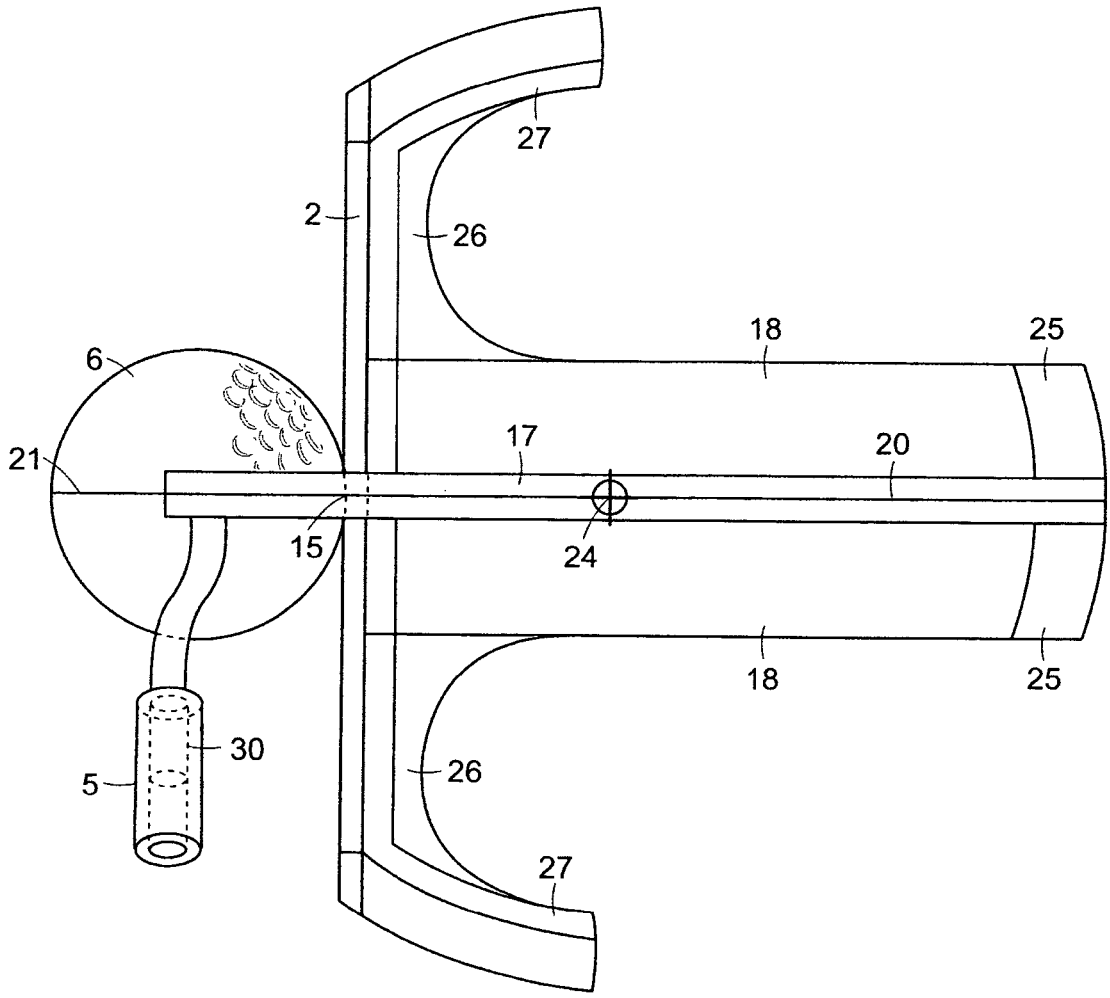
FIG. 7 is a plan view of another preferred embodiment of the present invention with a hosel similar to the embodiment of FIGS. 4, 5, and 6 but with a major or majority portion of putterhead weight concentrated within a mass ring concentric about and remote from the putterhead center of gravity.

FIG. 7 describes a putterhead of the present invention differing from the prior embodiments with respect to weight distribution within the putterhead. A major or majority portion of putterhead weight is located within a "mass ring" which ring has an outside diameter equal to the maximum horizontal plane distance between the putterhead center of gravity, and an inside diameter equal to 75% of said outside diameter. This weight distribution produces putterheads of extremely high Moment of Inertia (MOI) which reduces distance loss and misdirection whenever a ball is struck on the putterface 2 at a point remote from the intended strikepoint 15 which is directly in front of the putterhead center of gravity point 24.

Putterhead interior weight is reduced by using thin or perforated sections, or light weight materials such as aluminum, magnesium, titanium, or plastics, or combinations thereof for putterhead components interior to said mass ring. Mass ring components including the lateral 24 and rearward 25 weights can be of tungsten, lead, brass, steel, or other dense material and of longer or shorter arculate length as necessary. It is desirable to have the depth of weighting members such as 24 exceed their radial dimension both to keep most mass ring weight as close as possible to the outside mass ring diameter and to reduce the horizontal plane area and visual impact of all putterhead components outside the one golf ball diameter wide sighting field as previously described in FIG. 6. Thin section horizontal plane arches 26 support and rigidize relatively thin face 2 and weight supports 27. Color, finish, and sight lines for FIG. 7 are as described in FIG. 6.

The preceding drawings and descriptions present various embodiments of the present invention. Variations of these descriptions utilizing the principles and teachings described, remain within the scope of the present invention.

What is claimed is:

1. A golf putterhead having a strikeface with an intended strikepoint, and a bottom sole, said putterhead also having a forward extending section extending generally horizontally forward from the top of said strikeface a distance of ¼ to 1 ball diameter from a location approximately ½ ball diameter or more above said intended strikepoint which is above the horizontal sole plan, said forward extending section being in a vertical plane normal to said strikeface, before said forward extending section connects at or near the forward end of said forward extending section to a straight or bent golf shaft to the player side of said forward extending section, said forward extending section having a top surface or markings thereon, the forward extending sight line, which serves as an unobstructed sight or aim line toward the intended target, said forward extending section also increasing the static balance moment of the putterhead about said shaft by increasing the distance between the putterhead center of mass and the shaft axis, said putterhead also having a rearward putterhead extension with a rearward sight line on top of it with substantially the same top surface or markings as said forward extending sight line, said rearward putterhead extension being integral with or in rigid communication with said putterhead bottom sole, said rearward putterhead extension being in the same vertical plane as said forward extending section at the same or differing top surface elevation of said forward extending section, said rearward putterhead extension with said rearward sight line extending rearward from said putterface a distance of at least twice said forward extending section with said forward extending sight line length and not exceeding the width of said putterhead, said rearward extending sight line adding to and substantially lengthening the total sight or aim line length of said putterhead.

2. The putterhead of claim 1 wherein said forward extending section with said forward extending sight line extends forward from the strikeface approximately ¼ to ½ a ball diameter.

3. The putterhead of claim 1 wherein a shaft connection extends ¼ to 1 ball diameter in a direction generally normal to said forward extending section towards the golfer in such a manner as to not visually distract from or interrupt said forward extending sight line formed by the top surface or markings on said forward extending section and such that said shaft connection does not substantially reduce the gofer's view of the ball and wherein said shaft connection is arranged such that a putter with such putterhead is statically face balanced by having the shaft axis intersecting the vertical putterhead center line plane normal to the strikeface at approximately the same elevation as the clubhead center of gravity.

4. The putterhead of claim 1 wherein said forward extending sight line and said rearward putterhead extension with rearward sight line both have a sight or aim line of 0.025 to 0.5 inch width on the upper horizontal portion or central portion thereof with any adjacent putterhead portions, visible from above by the golfer, being of a differing or contrasting color or finish.

5. The putterhead of claim 4 wherein said sight lines are black or other dark finish while any portion of said shaft or shaft connection lying above a golf ball contacting the intended strikepoint of said putterhead, has a white or light finish such that it visually blends in with a golf ball centered under said forward extending hosel section.

6. The putterhead of claim 1 wherein that portion of said shaft connection or the bottom portion of a straight or bent golf shaft connecting to said putterhead, which is not over a golf ball contacting the intended strikepoint, is finished or colored dull green or another dark or non-reflective color such that said hosel or shaft sections are less visible and blend into the grass background when viewed by a golfer from above.

7. The putterhead of claim 1 used in conjunction with a golf ball marked with a dark line of a width approximately the width of said sight lines, along all or a portion of the ball's circumference or equator, which line the golfer aims at the target.

8. The putterhead of claim 1 wherein the weight of said rearward putterhead extension is reduced via one or more holes or apertures, the use of light weight materials, the use of thin section materials or combinations thereof.

9. The putterhead of claim 1 wherein the moment of inertia about the putterhead's center of gravity is increased by placing a major or majority portion of the putterhead's weight within 3 or more locations within a mass ring located between 75% and 100% of said putterhead's maximum horizontal distance from said putterhead center of gravity.

10. The putterhead of claim 1 wherein at least the forward most portion of said forward extending section or the lower shaft section proximate to it is made of or weighted with a heavy metal such as tungsten or lead to increase said putterhead's moment of inertia.

11. The putterhead of claim 1 wherein putterhead surfaces are provided within approximately one golf ball radius of the center of said rearward aim or sight line, visible to a golfer from above, said surfaces being of white or light surface finish providing a golf ball width sighting field while those remaining golfer visible putterhead surfaces adjacent to or more remote from said sighting field, which may include said sight lines, are of contrasting dark, black or green finish reducing their optical visibility, said ball width sighting field being extended in length by a golf ball at address in front of said putterhead strikepoint and below said forward extending sight line.

* * * * *